US007456852B2

(12) United States Patent
Mori et al.

(10) Patent No.: US 7,456,852 B2
(45) Date of Patent: Nov. 25, 2008

(54) DISPLAY APPARATUS, MOBILE TERMINAL AND LUMINANCE CONTROL METHOD IN THE MOBILE TERMINAL

(75) Inventors: Yukio Mori, Hirakata (JP); Susumu Tanase, Kadoma (JP); Atsuhiro Yamashita, Osaka (JP); Masutaka Inoue, Neyagawa (JP); Shigeo Kinoshita, Higashiosaka (JP); Haruhiko Murata, Ibaraki (JP); Takashi Yabukawa, Ibaraki (JP); Hiroyuki Goya, Kawanishi (JP)

(73) Assignee: Sanyo Electric Co., Ltd., Osaka (JP)

( * ) Notice: Subject to any disclaimer, the term of this patent is extended or adjusted under 35 U.S.C. 154(b) by 568 days.

(21) Appl. No.: 10/949,438

(22) Filed: Sep. 27, 2004

(65) Prior Publication Data

US 2005/0093958 A1 May 5, 2005

Related U.S. Application Data

(63) Continuation of application No. PCT/JP03/03792, filed on Mar. 27, 2003.

(30) Foreign Application Priority Data

Mar. 27, 2002 (JP) ..... 2002-088935
Mar. 27, 2002 (JP) ..... 2002-089125

(51) Int. Cl.
*G09G 5/10* (2006.01)

(52) U.S. Cl. ..... 345/690; 345/691; 345/692

(58) Field of Classification Search ..... 345/211–213, 345/76, 101, 97–102, 83, 520, 98, 100, 564, 345/565, 690–692, 685; 347/207; 700/22, 700/296; 353/122; 348/553; 396/429
See application file for complete search history.

(56) References Cited

U.S. PATENT DOCUMENTS 5,495,267 A * 2/1996 Fujitaka ..... 345/685
5,532,935 A * 7/1996 Ninomiya et al. ..... 700/296

(Continued)

FOREIGN PATENT DOCUMENTS

CN 1306312 8/2001

(Continued)

OTHER PUBLICATIONS

Chinese Office Action dated Mar. 16, 2007.

(Continued)

*Primary Examiner*—Prabodh Dharia
(74) *Attorney, Agent, or Firm*—McDermott Will & Emery LLP

(57) ABSTRACT

When an input detection unit has detected that no user operation has been performed to an organic EL display apparatus for a predetermined period of time or when a processing detection unit has detected that a predetermined processing is being performed, the input detection unit or the processing detection unit outputs an instruction to a reference voltage adjusting unit to modify a reference voltage referenced by a DAC unit upon conversion to an analog output signal.

6 Claims, 12 Drawing Sheets

U.S. PATENT DOCUMENTS

| | | | | |
|---|---|---|---|---|
| 5,754,150 | A | 5/1998 | Matsui | |
| 6,188,378 | B1 * | 2/2001 | Yamamoto et al. | 345/101 |
| 6,348,910 | B1 * | 2/2002 | Yamamoto et al. | 345/102 |
| 6,712,476 | B1 * | 3/2004 | Ito et al. | 353/122 |
| 6,801,811 | B2 * | 10/2004 | Ranganathan et al. | 700/22 |
| 7,012,588 | B2 * | 3/2006 | Siwinski | 345/83 |
| 7,102,632 | B2 * | 9/2006 | Siwinski | 345/212 |
| 7,148,929 | B1 * | 12/2006 | Mori et al. | 348/553 |
| 7,227,519 | B1 * | 6/2007 | Kawase et al. | 345/77 |
| 2002/0067923 | A1 * | 6/2002 | Fujimura | 396/429 |
| 2002/0180723 | A1 * | 12/2002 | Siwinski | 345/212 |
| 2002/0186214 | A1 * | 12/2002 | Siwinski | 345/212 |
| 2003/0135288 | A1 * | 7/2003 | Ranganathan et al. | 700/22 |
| 2003/0193472 | A1 * | 10/2003 | Powell | 345/102 |
| 2006/0132401 | A1 * | 6/2006 | Yamazaki et al. | 345/81 |
| 2006/0202924 | A1 * | 9/2006 | Koyama | 345/76 |

FOREIGN PATENT DOCUMENTS

| | | | |
|---|---|---|---|
| JP | 6-175615 | | 6/1994 |
| JP | 8-221040 | | 8/1996 |
| JP | 9-281925 | | 10/1997 |
| JP | 10-171427 | | 6/1998 |
| JP | 10-274961 | | 10/1998 |
| JP | 2000-148118 | | 5/2000 |
| JP | 2000-242210 | | 9/2000 |
| JP | 1289184 | A | 3/2001 |
| JP | 2001-94662 | | 4/2001 |
| JP | 2001-142427 | | 5/2001 |
| JP | 2001-345928 | | 12/2001 |
| JP | 2001-350450 | | 12/2001 |
| JP | 2002-032058 | | 1/2002 |
| KR | 2001-34326 | | 4/2001 |

OTHER PUBLICATIONS

Korean Office Action issued in corresponding Korean Patent Application No. 10-2004-7015319 dated Dec. 29, 2006.

Chinese Office Action, with English translation, issued in Chinese Patent Application No. CN 038071975, mailed Aug. 17, 2007.

Korean Office Action issued in Korean Patent Application No. KR 10-2004-7015319, dated May 29, 2007.

Japanese Office Action, with English Translation, issued in Japanese Patent Application No. JP 2003-579206, dated Feb. 19, 2008.

Japanese Office Action, with English Translation, issued in Japanese Patent Application No. JP 2003-579206 dated Jul. 8, 2008.

* cited by examiner

DISPLAY APPARATUS, MOBILE TERMINAL AND LUMINANCE CONTROL METHOD IN THE MOBILE TERMINAL

CROSS-REFERENCE TO RELATED APPLICATIONS

This application is a continuation application and claims the priority benefit of Patent Cooperation Treaty Application Number PCT/JP03/03792, filed on Mar. 27, 2003, which in turn claims the priority benefits of Japanese Patent Application Number JP2002-089125, filed on Mar. 27, 2002, and Japanese Patent Application Number JP2002-088935, filed on Mar. 27, 2002.

BACKGROUND OF THE INVENTION

1. Field of the Invention

The present invention relates to a display apparatus, and it particularly relates to a technology for reducing deterioration of an optical element comprised in the display apparatus.

2. Description of the Related Art

Notebook type personal computers and mobile terminals are spreading widely. Today, a liquid crystal display apparatus is mainly used for display apparatus thereof. And an organic EL (Electro Luminescence) display apparatus is expected as a new flat-type display apparatus. As for the liquid crystal display apparatus, the straitness of view angle and the lateness of response speed still remain as subjects. On the other hand, the organic EL display apparatus can achieve high luminosity and high efficiency while conquering the above-mentioned subjects.

As for the organic EL display, however, a change of an optical element with the passage of time, that is, a deterioration of the optical element cannot be avoided because of a characteristic thereof. Therefore, a white balance may collapse or a variation of luminance may be arisen by continuous use, even if the white balance has been adjusted at the time of manufacturing. It is known that the organic EL display has remarkable deterioration of the optical element compared with the liquid crystal display, and it is recognized that it is a big problem for the quality of a product.

SUMMARY OF THE INVENTION

An object of the present invention is to reduce the above-mentioned deterioration of an optical element.

An aspect of the present invention relates to a display apparatus. This apparatus comprises: an optical element; and a luminance changing unit which lowers a luminance to be set to the optical element when there is no input from a user for a predetermined period of time. That is, if no user operation has been performed to the display apparatus for a predetermined period of time, the luminance changing unit may judge that the user is not using the display apparatus, and may darken a display image.

Here, a display apparatus means an apparatus comprising a display screen, for example, a cellular phone, PDA (Personal Digital Assistants), PC (Personal Computer), and so forth. In an organic EL display apparatus, for example, deterioration may occur by passage of time as mentioned above in an organic light emitting diode (hereinafter, simply referred to as "OLED") which is an optical element thereof. It is thought that the cause of the deterioration is based on the current supplied. That is, when a luminance is heightened, the current supplied increases and advance of the deterioration becomes large. Therefore, advance of deterioration of the optical element is suppressed by adjusting the luminance low according to the user's use situation.

Another aspect of the present invention also relates to a display apparatus. This apparatus comprises: an optical element; and a luminance changing unit which lowers a luminance to be set to the optical element during advance of a predetermined processing.

For example, in a case where a cellular phone is adopted as the display apparatus, after inputting a partner's telephone number for a telephone call, a user does not see generally a display screen so much. Therefore, even if a display image is darkened, a user's operativity or visibility is influenced little in many cases. Moreover, when displaying a notification showing that a certain file is being downloaded, for example, darkening a display image causes little trouble, since visibility is not required so much.

The luminance changing unit may lower a maximum luminance to be allowed to set to the optical element. A digital signal which is a video source in a liquid display apparatus or an organic EL display apparatus, is generally adjusted by a driving circuit of a display screen according to characteristic thereof before outputted to the display screen, converted to an analog signal by a digital to analog converter (DAC) finally, and outputted to the display screen. At this time, a maximum luminance to be set to the optical element originally may be lowered. That is, a process of lowering the maximum luminance to 50% of the original maximum luminance, for example, may be performed.

The luminance changing unit may adjust a gain of a luminance so that a brightness of whole of a display image may become dark. That is, a digital signal inputted to a driving circuit may be lowered. A fixed value may be subtracted from the inputted digital signal, or the predetermined value may be multiplied by the digital signal to lower the digital signal. In short, the processing on which a level of the digital signal is dropped may be performed.

The luminance changing unit may perform gamma correction so that a brightness of whole of a display image may become dark. Generally, the gamma correction is a processing to correct a input-luminance characteristic of a display screen so that the input-luminance characteristic may become a predetermined characteristic. It is possible to darken the display image by modifying a correction curve of this gamma correction.

The luminance changing unit may adjust a luminance so that text data included in a display image can be highlighted. An area other than text data may be made darker than the text data so that a user can recognize the text data. Even if a color of the text data is black, the area other than the text data may be made darker than original brightness. The luminance changing unit may set the brightness of the area other than the text data as the brightness of a grade where the area other than the text data can be distinguished from the text data.

The luminance changing unit may reduce the number of gradation levels of a display image to generate a summary image, and may lower a maximum luminance to be set to the optical element in accordance with new number of gradation levels of the summary image. The luminance changing unit may change the number of the gradation of a display image originally having 16 gradation levels into 8 gradation levels, which is half of the number of the original gradation levels, for example, and may change the maximum luminance level into half in accordance with the change of the number of the gradation levels. By carrying out like this, the display image can be made dark, maintaining the outline of the original display image.

The luminance changing unit may control power of a power supply which supplies electric power to the optical element. The power supply is generally connected to a display screen to supply the electric power to the optical element comprised with the display screen. The luminance changing unit may darken the display image by variably controlling the voltage of the power supply. The luminance changing unit may control the value of the current supplied by the power supply or control both of the current and the voltage.

The luminance changing unit may adjust ratio between an emitting period and a non-emitting period of the optical element. In an active matrix type display apparatus, for example, one scanning period generally includes a writing period and an emitting period. The display image can be made darker than original brightness by setting up the non-emitting period in which the optical element does not actually emit in this emitting period. Moreover, in a case where the optical element is emitted at the predetermined luminance by setting the non-emitting period and controlling it, the luminance changing unit may make the display image darker than original brightness by making the non-emitting period longer than normal display.

It is to be understood that any combinations of the foregoing components, and expressions of the present invention having their methods, apparatuses, systems, recording media, computer programs, and the like converted mutually are also intended to constitute applicable aspects of the present invention.

This summary of the invention does not necessarily describe all necessary features so that the invention may also be a sub-combination of these described features.

BRIEF DESCRIPTION OF THE DRAWINGS

The above described objectives, other objectives, features and advantages are further made clear by the following preferred embodiments and drawings accompanied thereby.

DETAILED DESCRIPTION OF THE INVENTION

The invention will now be described based on the preferred embodiments. This does not intend to limit the scope of the present invention, but exemplify the invention.

Basic Technology

Figure 1:
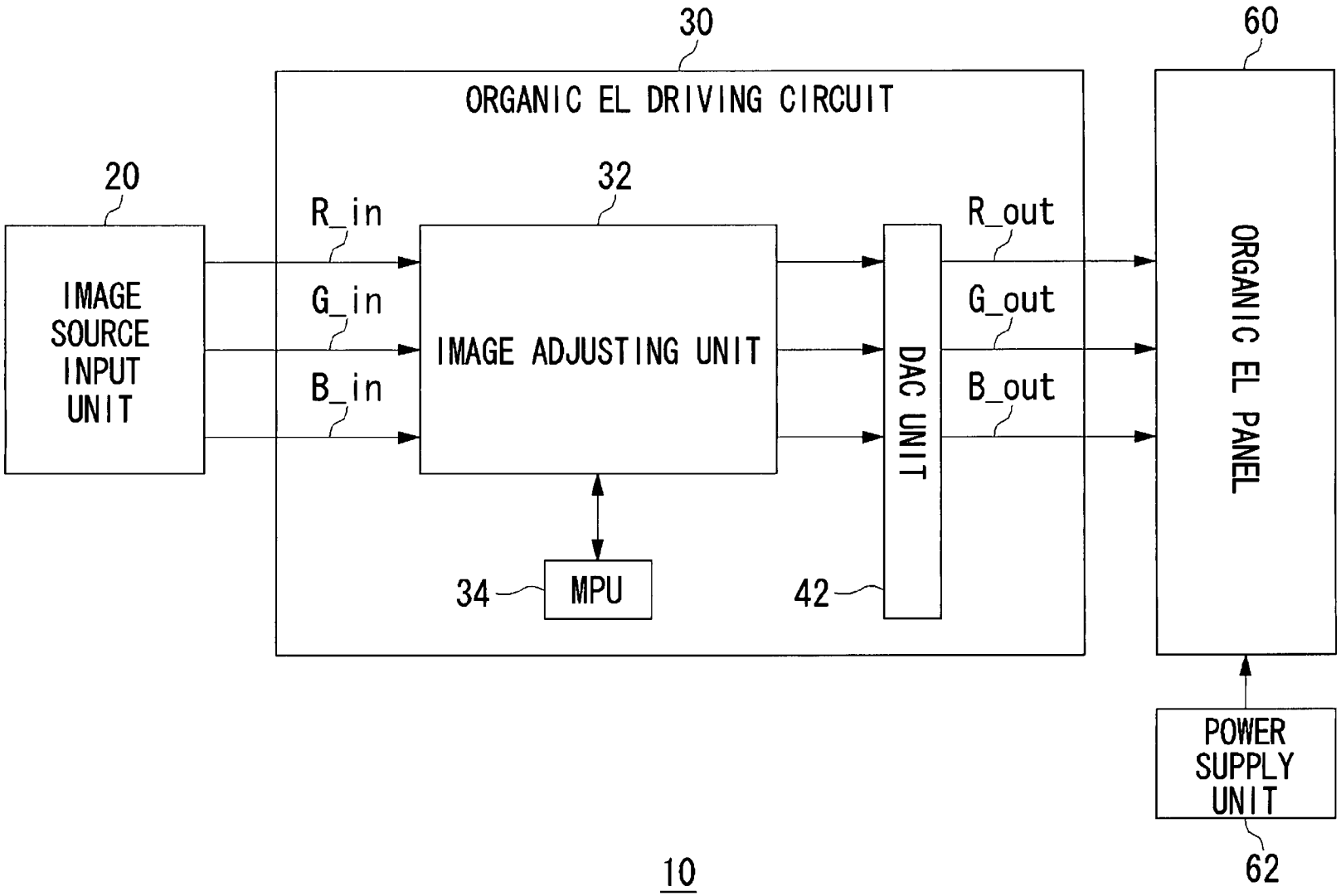
FIG. 1 is a figure showing a basic structure of an organic EL display apparatus.

A general basic structure of an organic EL display apparatus which is applied to the present invention is explained. FIG. 1 is a block diagram showing a basic structure of the organic EL display apparatus. The organic EL display apparatus comprises an image source input unit 20, an organic EL driving circuit 30, an organic EL panel 60, and a power supply unit 62 which supplies electric power for optical elements comprised in the organic EL panel 60.

The organic EL driving circuit 30 includes an image adjusting unit 32 which performs various processings described later to digital image signals inputted from the image source input unit 20, an MPU (Micro Processing Unit) 34 which performs calculation when the organic EL driving unit 30 performs those processings, a DAC unit 42 which converts the image signal processed by the image adjusting unit 32 to an analog signal. The organic EL driving circuit 30 further includes a control signal generation unit which generates timing control signals and a memory which functions as a table at the time of performing actual process, which are not shown in FIG. 1.

The image adjusting unit 32 performs an offset control for adjusting a brightness, a gain control for adjusting a contrast of the image, and processing which adjusts the input image signal to which the gamma correction is performed to the voltage-luminance (V-T) characteristic of the organic EL panel 60.

Operation of the above mentioned structure is explained briefly. First, three kinds of RGB of R, G and B digital signals R_in, G_in, and B_in (hereinafter, these three kinds of digital signals are referred to as "digital input signals" as a whole) are inputted into the image adjusting unit 32 from the image source input unit 20. Next, the offset control and the gain control are performed to the digital input signals by the image adjusting unit 32. Finally, adjusted digital input signals are outputted to the organic EL panel 60 as voltages of three kinds of R, G and B analog signals R_out, G_out and B_out (hereinafter, these three kinds of analog signals are referred to as "analog output signals" as a whole).

Figure 2:
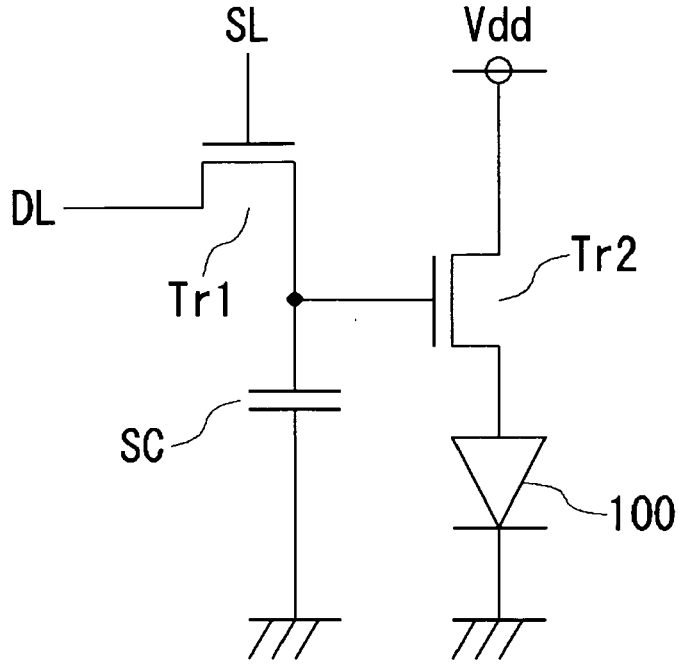
FIG. 2 is a figure showing a circuit of a single pixel comprised in the organic EL display apparatus.

FIG. 2 shows a general basic circuit of a single pixel comprised in an active-matrix type organic EL display apparatus. The single pixel comprises an OLED 100, a selecting transistor Tr1, a driving transistor Tr2 and a capacitor SC. A data line DL, a scan line SL and a power supply line Vdd are also connected to the pixel.

When the scan line SL goes high and a period of writing the luminance data has come, the selecting transistor Tr1 goes ON and the luminance data applied to the data line DL is set on the driving transistor Tr2 and held in the capacitor SC. Next, when a light-emitting period has come, the OLED 100 emits light with a luminance corresponding to the luminance data set on the driving transistor Tr2.

Figure 3:
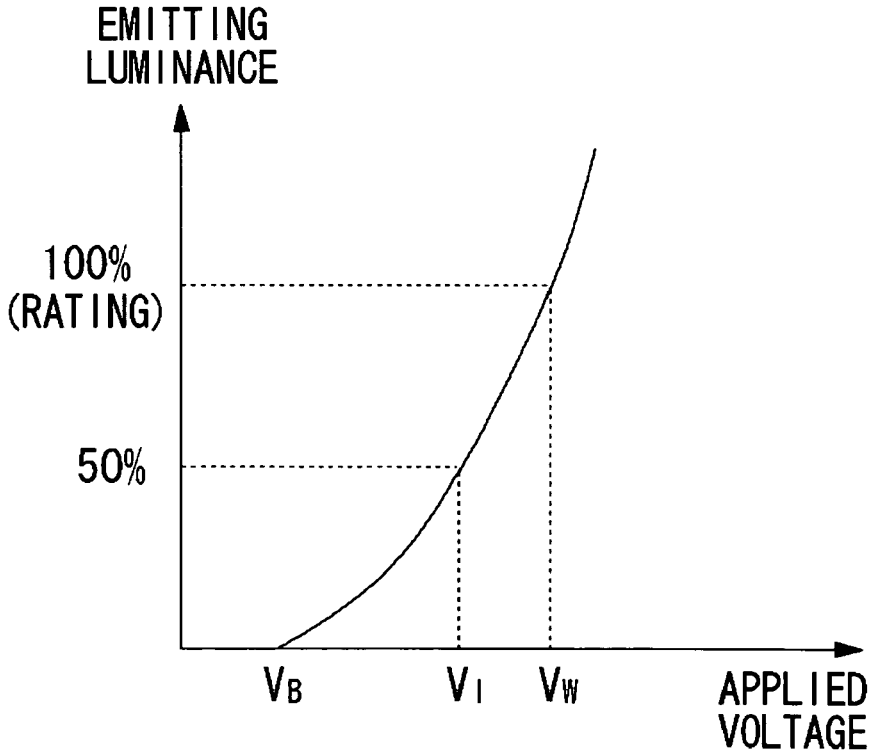
FIG. 3 is a figure showing a relationship between a voltage applied to an optical element of the organic EL display and a luminance of the optical element.

FIG. 3 shows a relation between an applied voltage which is the luminance data applied to the data line DL and emission luminance. There is a threshold voltage required to emit light for the OLED 100. Here, this threshold voltage is called "black-side reference voltage VB". A voltage set on the OLED 100 to emit light with a rated luminance is called "white-side reference voltage VW". In FIG. 3, the luminance is 50% of the rated luminance when V1 is applied. Accordingly, the DAC unit 42 stores a table which represents the black-side reference voltage VB and the white-side reference voltage VW, which is not shown in FIG. 3.

In terms of hardware, this structure can be realized by a CPU, a memory and other LSIs of an arbitrary computer. In terms of software, it is realized by memory-loaded programs or the like, but drawn and described here are functional blocks that are realized in cooperation with those. Thus, it is understood by the skilled in the art that these functional blocks can be realized in a variety of forms by hardware only, software only or the combination thereof.

Embodiments are explained below based on the above basic technology. In a first to fifth embodiment, if an operation of a user to the display apparatus is not performed over a predetermined period of time, and during downloading a file, a processing of darkening a display image is performed.

First Embodiment

In a first embodiment, when the analog signal is outputted to the organic EL panel 60, the display image is made dark by adjusting the reference voltage used as the basis at the time of converting the digital signal into the analog signal in the DAC unit 42 to lower the luminance. That is, the display image is darkened by setting the voltage to lower value than original value when converting the digital signal to the voltage which is the analog signal.

Figure 4:
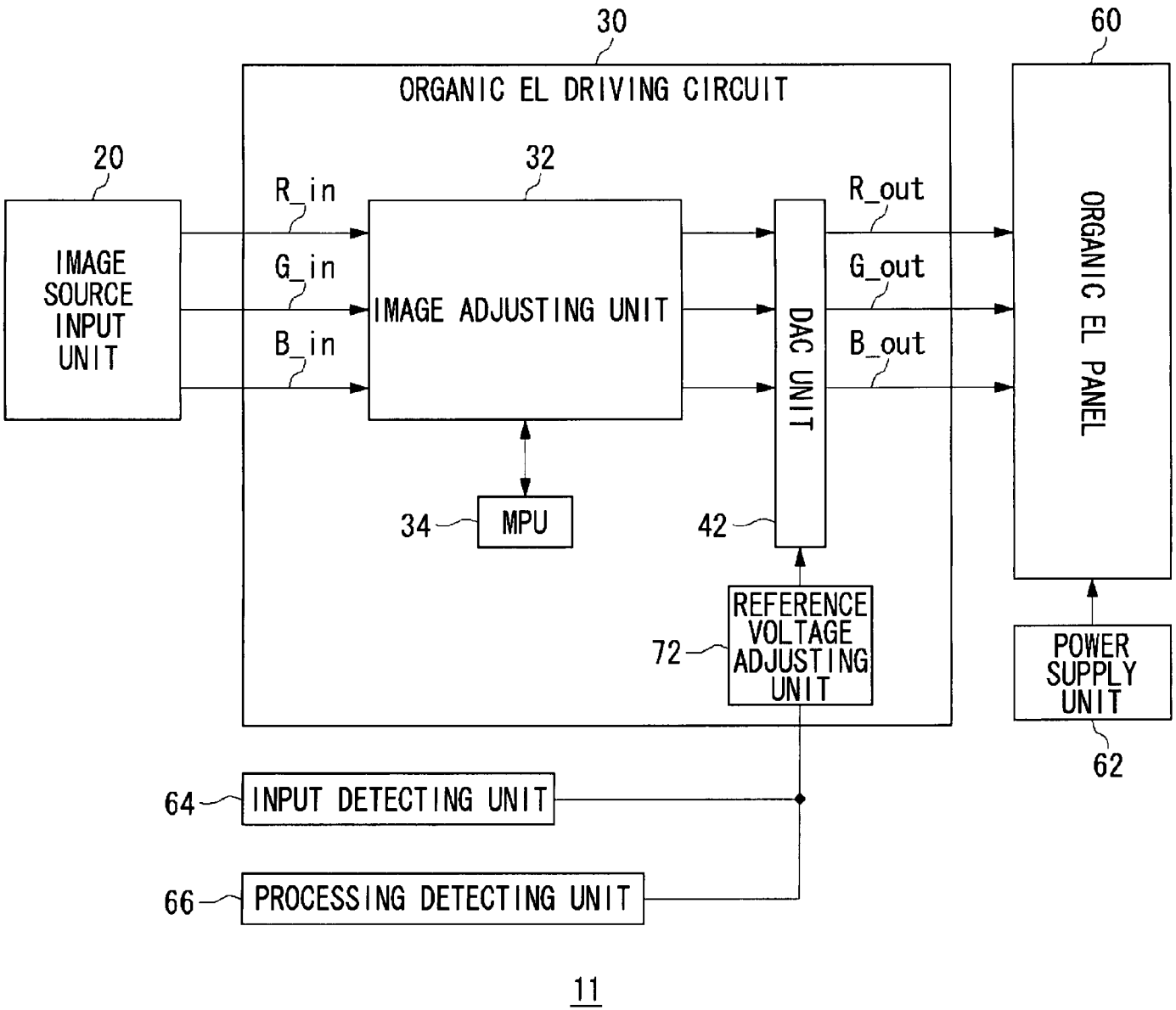
FIG. 4 is a figure showing a structure of the organic EL display apparatus comprising a reference voltage adjusting unit according to a first embodiment.

FIG. 4 shows a circuit structure of an organic EL display apparatus 11 which realizes the first embodiment. The circuit structure of the organic EL display apparatus 11 is based on the structure of the organic EL display apparatus 10 shown in the basic technology. Characteristic structure in the first embodiment is explained hereinafter.

The organic EL display apparatus 11 comprises an input detecting unit 64 which detects the fact that there is no operation from a user to the display apparatus for a predetermined term, and a processing detecting unit 66 which detects a processing which is performed in the display apparatus. The organic EL driving unit 30 comprises a reference voltage adjusting unit 72 and lowers the maximum luminance allowed to set in the optical element by method mentioned below. The input detecting unit 64 and the processing detecting unit 66 are comprised in the display apparatus according to a second to a fifth embodiment commonly.

At first, when the input detecting unit 64 detects the fact that there is no operation from the user to the organic EL display apparatus 11 for a predetermined term or the processing detecting unit 66 detects the advance of the predetermined processing, the DAC unit 42 instructs the reference voltage adjusting unit 72 to change the reference voltage. That is, the width of the signal outputted to the organic EL panel 60 is changed by controlling the white-side reference voltage corresponding to the maximum luminance. For example, the maximum luminance of the optical element is normally 100% of the rating value, but the maximum luminance is changed to 50% of the rating value for example. That is, the rating voltage corresponding to the maximum luminance is changed from $V_W$ to $V_1$, in the relation between applied voltage and the luminance shown in FIG. 3.

Second Embodiment

In a second embodiment, the image to be displayed is made darker than original brightness by performing a gain control or a gamma control to a digital signal inputted in the organic EL driving circuit 30.

Figure 5:
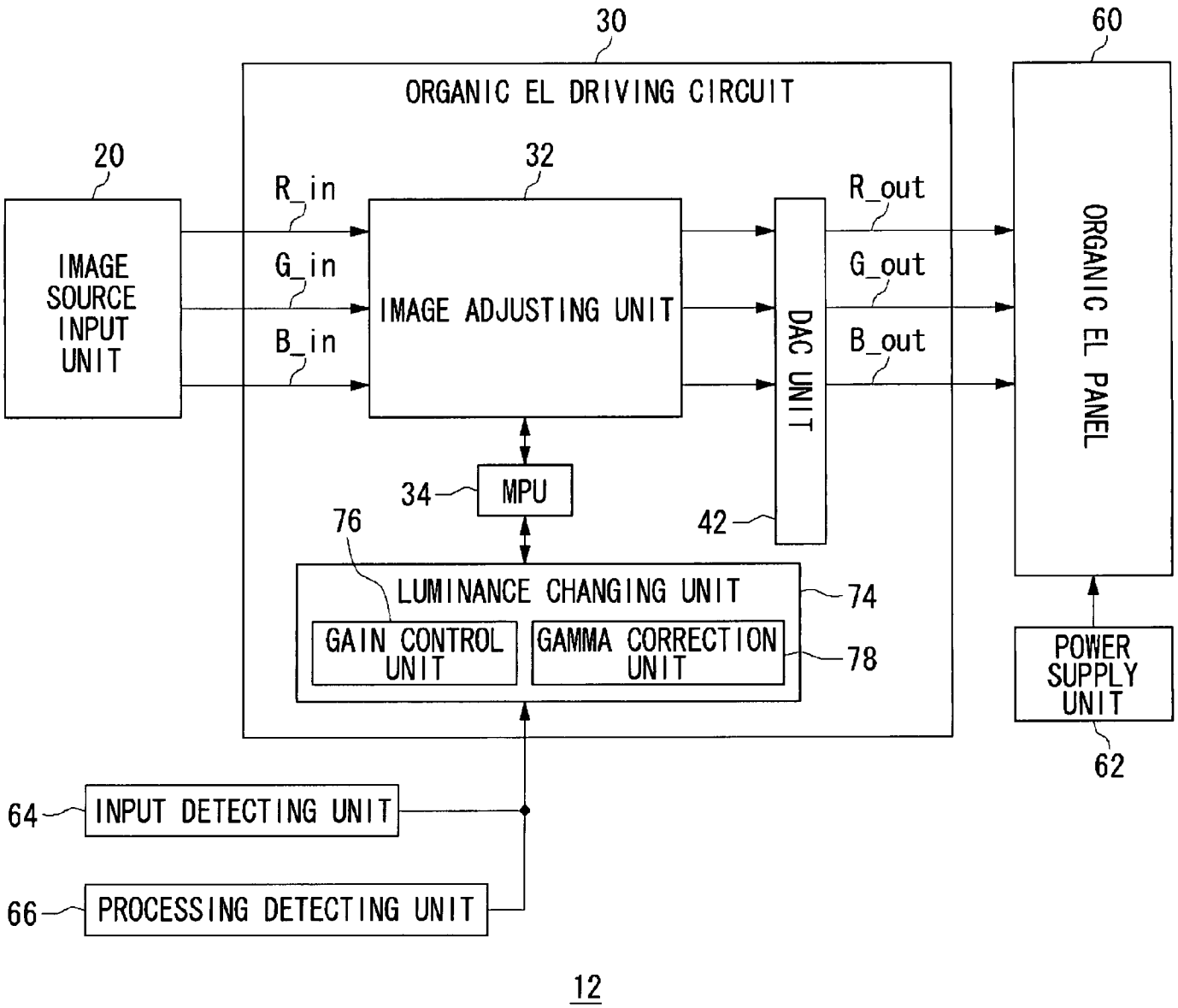
FIG. 5 is a figure showing a structure of the organic EL display apparatus comprising a luminance changing unit according to a second embodiment.

FIG. 5 shows a circuit structure of the organic EL display apparatus 12 of the present embodiment. This circuit structure is also based on the circuit structure shown in the basic technology. The organic EL driving circuit 30 comprises a luminance changing unit 74 which is characteristic in the second embodiment. The luminance changing unit 74 includes a gain control unit 76 for adjusting a gain of the signal and a gamma correction unit 78 which performs the gamma correction. These gain control and the gamma correction are performed in collaboration with the MPU 34. Here, the image adjusting unit 32 performs the gain control and the gamma correction to make the display image proper. On the other hand, the gain control performed by the luminance changing unit 74 and the gamma correction performed by the gamma correction unit 78 is performed to make the display image darker than original.

Third Embodiment

In a third embodiment, a processing to lower a tone of a display image is performed to a digital signal inputted to an organic EL driving circuit 30 to make the display image darker than original brightness.

Figure 6:
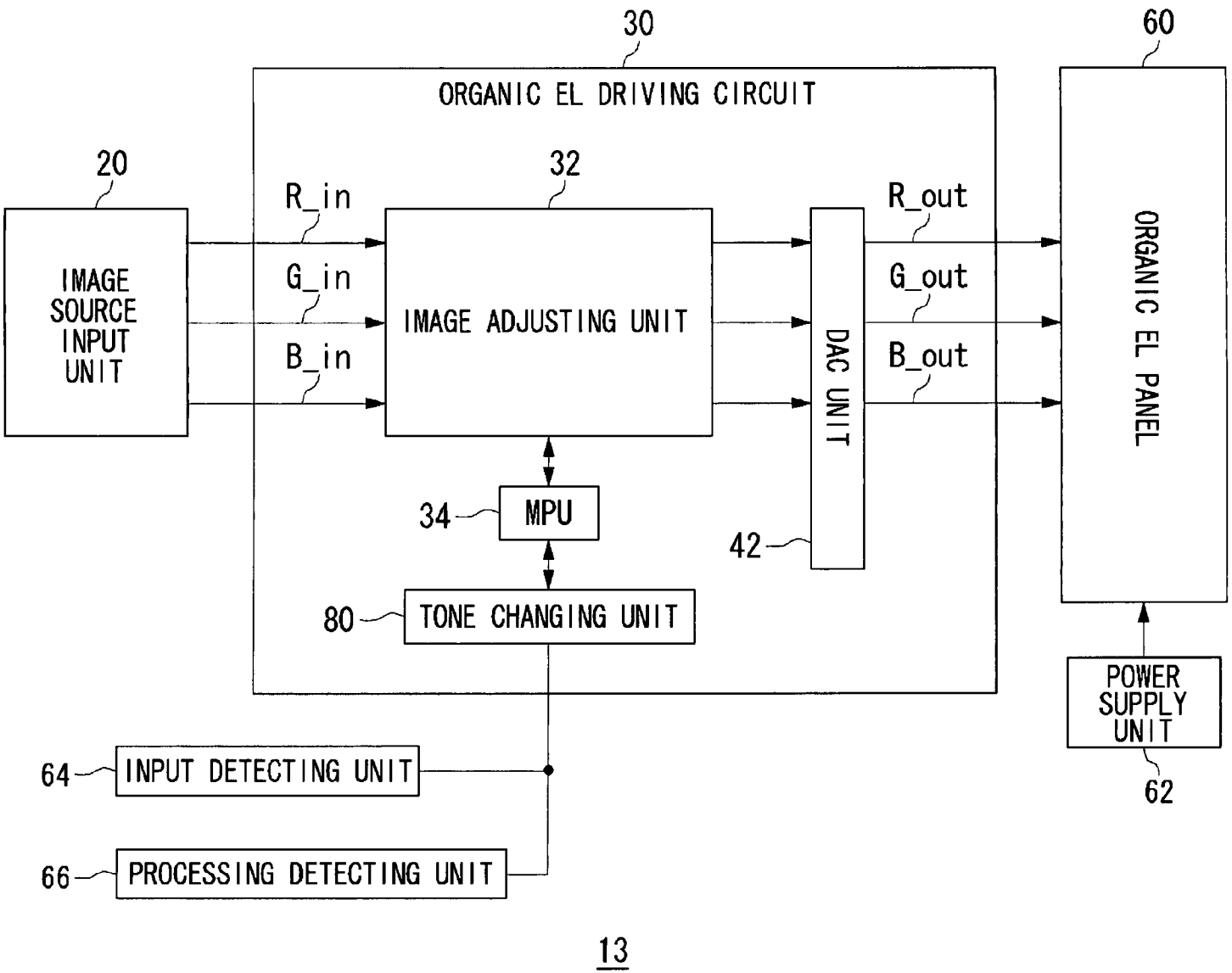
FIG. 6 is a figure showing a structure of the organic EL display apparatus comprising a gradation changing unit according to a third embodiment.

FIG. 6 shows an organic EL display apparatus 13 according to the third embodiment, which is also based on the circuit structure shown in the basic technology. The organic EL driving circuit 30 comprises a tone changing unit 80 which is characteristic in the third embodiment.

The tone changing unit 80 reduces the number of gradations of a display image to generate a summary image. The tone changing unit 80 changes the number of the gradation of the display image originally having 16 gradation levels into 8 gradation levels, which is half of the number of the original gradation levels, for example, and changes the maximum luminance level into half in accordance with the change of the number of the gradation levels. By carrying out like this, the display image can be made dark, and the advance of the degradation of the optical element can be suppressed. The processing of the tone changing unit 80 is also performed in collaboration with the MPU 34.

Fourth Embodiment

In a fourth embodiment, the display image is made darker than original brightness by controlling a voltage of a power supply unit 62 which supplies electric power to the organic EL panel 60. One of the method of controlling the voltage is lowering the voltage level supplied to the organic EL panel 60, for example, from 10V as original to 5V. Another method is setting up the non-emitting period to the optical element. That is, the period where the voltage supplied from the power supply unit 62 to the optical element is made zero or the voltage by which the optical element does not emit is set up in the period where the optical element emits originally. These two methods may be combined.

Figure 7:
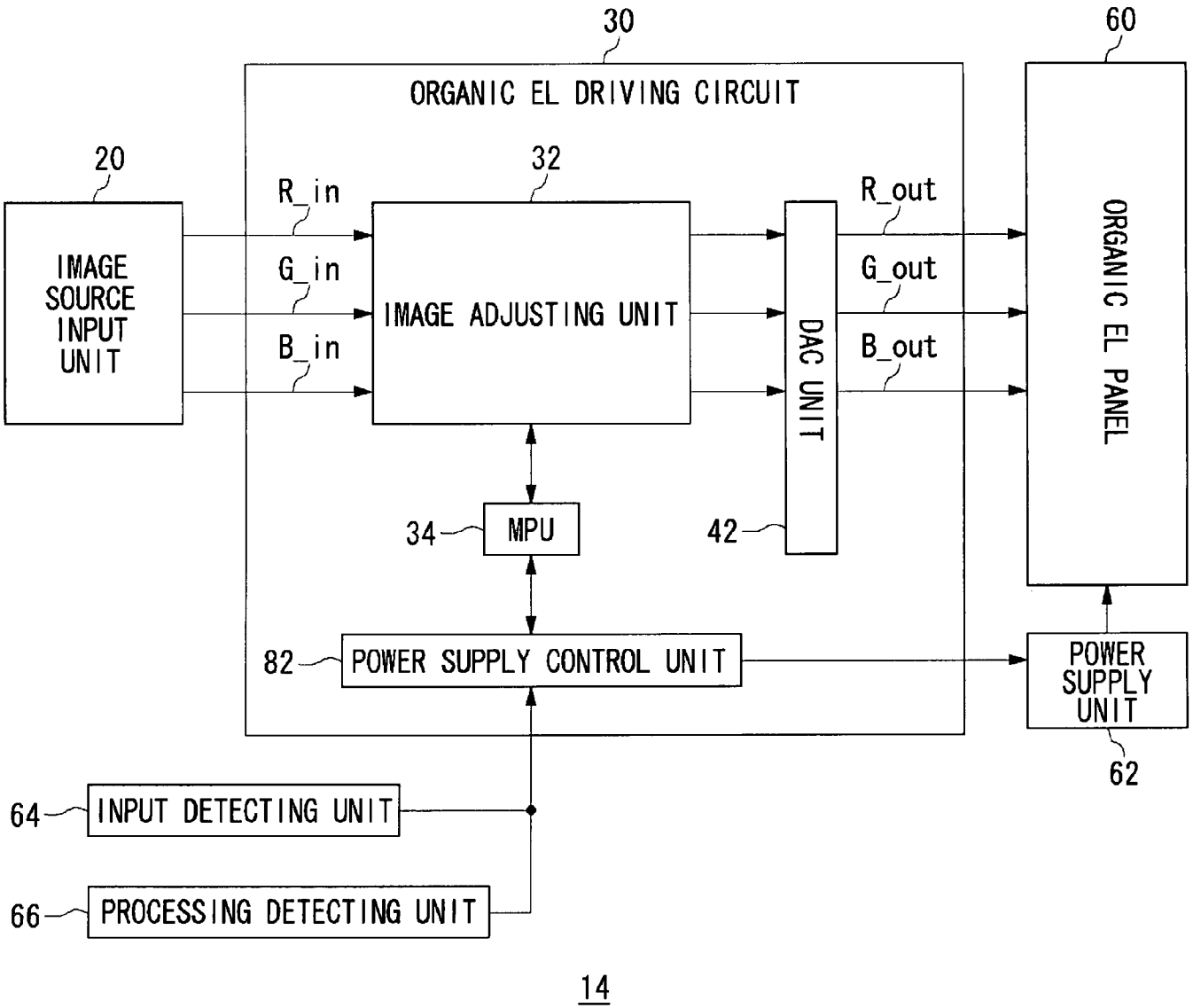
FIG. 7 is a figure showing a structure of the organic EL display apparatus comprising a power source control unit according to a fourth embodiment.

FIG. 7 shows a circuit structure of the organic EL display apparatus 14 according to the fourth embodiment. This is also based on the structure of the organic EL display apparatus shown in the basic technology. The organic EL driving circuit 30 comprises a power supply control unit 82, which is characteristic in the fourth embodiment, and controls the voltage of the power supply unit 62 in collaboration with the MPU 34.

Fifth Embodiment

In a fifth embodiment, text data contained in a image to be displayed is highlighted, and the other display area is relatively made dark. In this case, text data may be extracted by arbitrary method.

Figure 8:
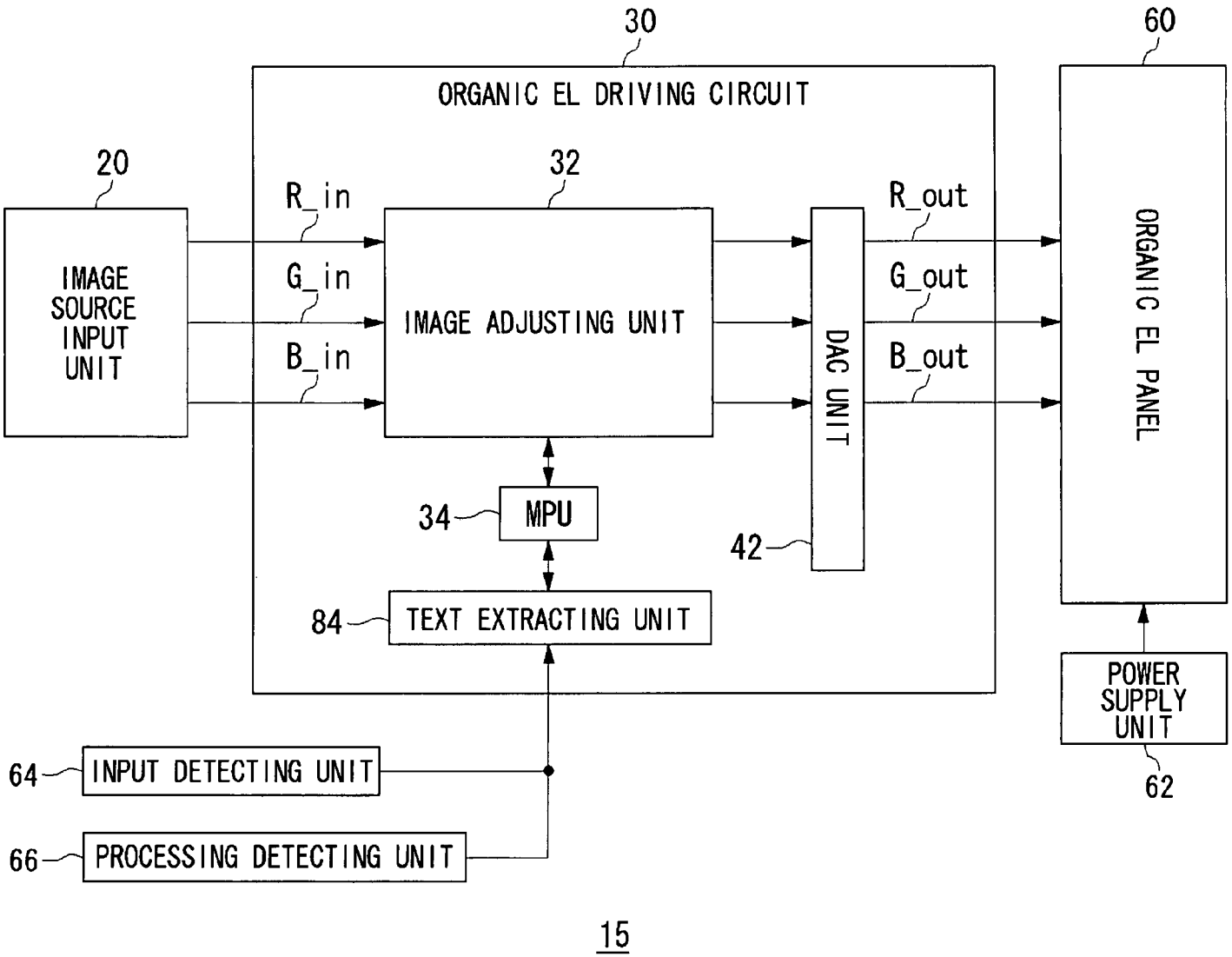
FIG. 8 is a figure showing a structure of the organic EL display apparatus comprising a text extracting unit according to a second embodiment.

FIG. 8 shows a circuit structure of an organic EL display apparatus 15 according to the fifth embodiment. This is also based on the structure of the organic EL display apparatus 10 shown in the basic technology. The organic EL display apparatus 15 comprises a text extracting unit 84, which is characteristic in the fifth embodiment. The text extracting unit 84 extracts the text data included in the display apparatus as mentioned above, and the text data is displayed in the predetermined luminance, and the luminance of the other area is set as the luminance darker than the text data. This processing is also performed in collaboration with the MPU 34.

As mentioned above, according to the first to fifth embodiment, current supplied to the OLED which is the optical element comprised in the organic EL panel 60 can be reduced without any trouble for a user, and thereby, the advance of the deterioration of the OLED can be reduced.

Sixth Embodiment

[Field of the Sixth Embodiment]

The technical field of the sixth embodiment relates to a mobile terminal comprising an organic EL display and a luminance control method in the mobile terminal comprising the organic EL display.

[Related Art of the Sixth Embodiment]

There are a passive type which has simple matrix structure and an active type which uses TFT in an organic EL display.

Figure 9:
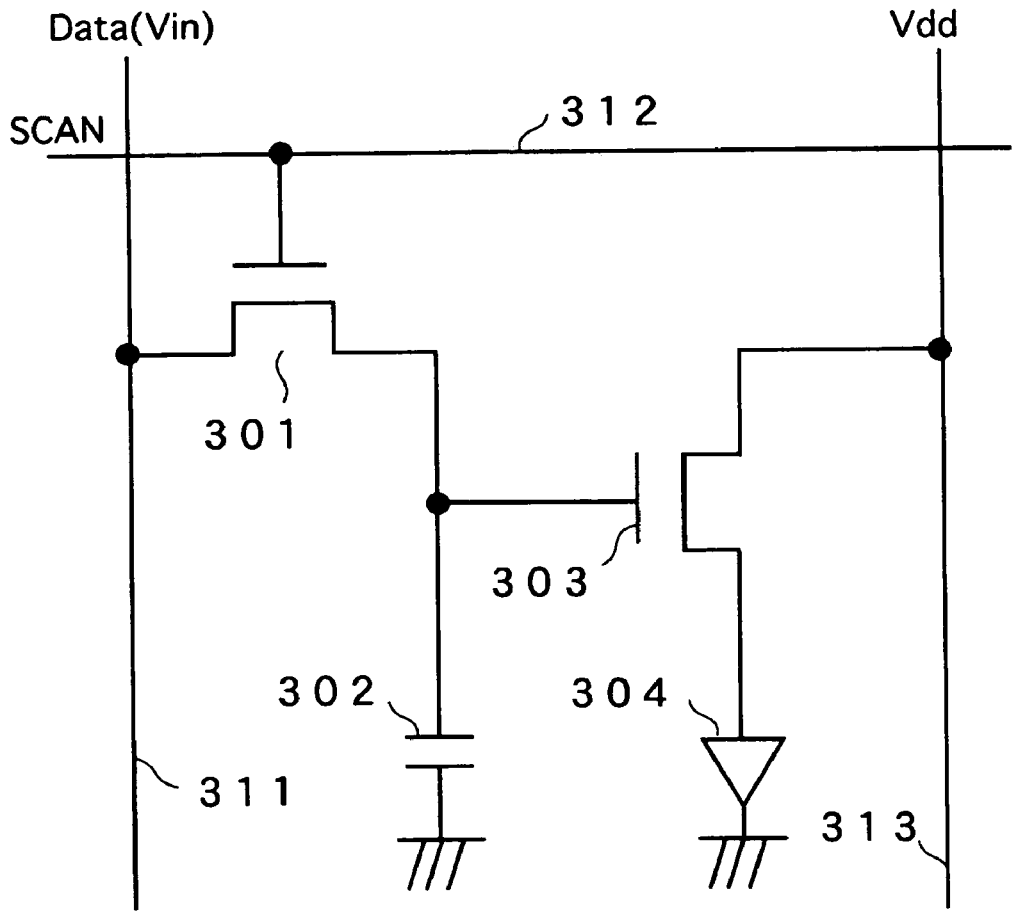
FIG. 9 is a circuit diagram showing a basic pixel structure of an active type organic EL display.

FIG. 9 shows a basic pixel structure of the active type organic EL display. A circuit of the single pixel of the active type organic EL display is comprised with a switching TFT 301, a condenser 302, a driving TFT 303 and an organic EL element 304.

A drain electrode of the switching TFT 301 is applied with a display signal Data (Vin) via a display signal line 311. A select signal SCAN is applied for a base electrode of the driving TFT 301 via a select signal line 312. A source electrode of the switching TFT 301 is connected to the base electrode of the driving TFT 303 and is grounded via the condenser 302.

A drain electrode of the driving TFT 303 is applied with a driving power voltage Vdd. A source electrode of the driving TFT 303 is connected to an anode of the organic EL element 304. A cathode of the organic EL element 304 is grounded.

On and off of the switching TFT 301 is controlled by the select signal SCAN. The condenser 302 is charged by the display signal Data (Vin) supplied via the switching TFT 301 when the switching TFT 301 is on, and holds the charged voltage when the switching TFT 301 is off. The driving TFT 303 supplies current according to the voltage which the condenser 302 holds and applied to the base electrode thereof to the organic EL element 304.

Figure 10:
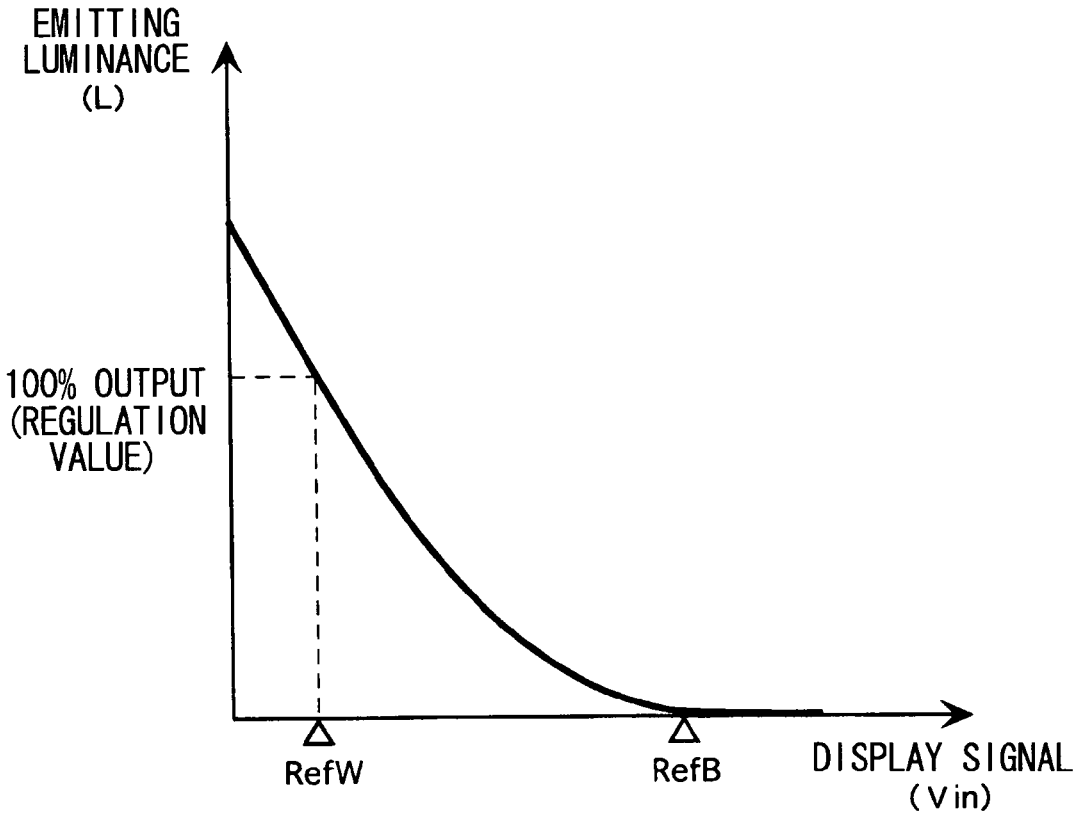
FIG. 10 is a graph showing a relation between a display signal Data (Vin) and an emitting luminance (driving current) of the organic EL element in the basic pixel structure shown in FIG. 9.

FIG. 10 shows a relation between a display signal DATA (Vin) and emitting luminance (driving current) of the organic EL element 304 in the basic pixel structure shown in FIG. 9.

In FIG. 10, "RefW" shows a white-side reference voltage for defining the emitting luminance corresponding to a white level of the input signal, and "RefB" shows a black-side reference voltage for defining the emitting luminance corresponding to a black level of the input signal, respectively.

By the way, in the active type organic EL displays as mentioned above, big current flows through the organic EL element 304 when displaying the bright image as a whole screen (image with high luminosity). If the big current flows through the organic EL element 304, power consumption will increase. Moreover, if the big current continuously flows through the organic EL element 304, the so-called phosphor burn-in phenomenon will occur, or degradation of the performance thereof will be accelerated.

[Summary of the Sixth Embodiment]

The object of the sixth embodiment is to provide a mobile terminal comprising an organic EL display and a luminance control method in the mobile terminal, which can prevent a generation of a phosphor burn-in and can reduce a degradation of performance of the organic EL element.

An aspect of the present embodiment is a mobile terminal comprising: an organic EL display; a distinction means which distinguishes a type of a content displayed on said organic EL display; a control means which controls display luminance of an image to be displayed on said organic EL display in accordance with the type of the content distinguished by said distinction means.

In the mobile terminal, the control means may include: a DA converter which converts a digital image signal corresponding to the content to be displayed on said organic EL display to an analog image signal, based on an input/output characteristic defined by a given reference voltage, and supplies the analog image signal to said organic EL display; and a reference voltage adjusting circuit which controls the reference voltage to be supplied to said DA converter based on the type of the content distinguished by said distinction means.

In the mobile terminal, there may be a black-side reference voltage for defining an emitting luminance corresponding to a black level of an input signal and a white-side reference voltage for defining an emitting luminance corresponding to a white level of the input signal as reference voltages supplied to said DA converter, and the reference voltage adjusting circuit may control the white-side reference voltage based on the kind of the content distinguished by the distinction means.

Another aspect of the present embodiment is a luminance control method in a mobile terminal comprising an organic EL display, the method including: a first step of distinguishing a type of a content to be displayed on the organic EL display; and a second step of controlling a display luminance of an image to be displayed on the organic EL display in accordance with the type of the content distinguished by the first step.

In the luminance control method in the mobile terminal, the mobile terminal may comprise a DA converter which converts a digital image signal corresponding to the content to be displayed on the organic EL display to an analog image signal, based on an input/output characteristic defined by a given reference voltage, and supplies the analog image signal to the organic EL display; and the second step may control an amplitude of an image input signal by controlling a reference voltage supplied to the DA converter based on the type of the content distinguished by said first step.

In the luminance control method in the mobile terminal, there may be a black-side reference voltage for defining an emitting luminance corresponding to a black level of an input signal and a white-side reference voltage for defining an emitting luminance corresponding to a white level of the input signal as reference voltages supplied to the DA converter, and the second step may control the white-side reference voltage based on the kind of the content distinguished by the distinction means.

Optional combinations of the aforementioned constituting elements, and implementations of the invention in the form of methods, apparatuses and systems may also be practiced as additional aspects of the present invention.

[Example of the Sixth Embodiment]

Hereinafter, an example where the present invention is adopted to a cellular phone will be explained with reference to FIGS. 11 to 14.

[1] Explanation of the Structure of the Cellular Phone

Figure 11:
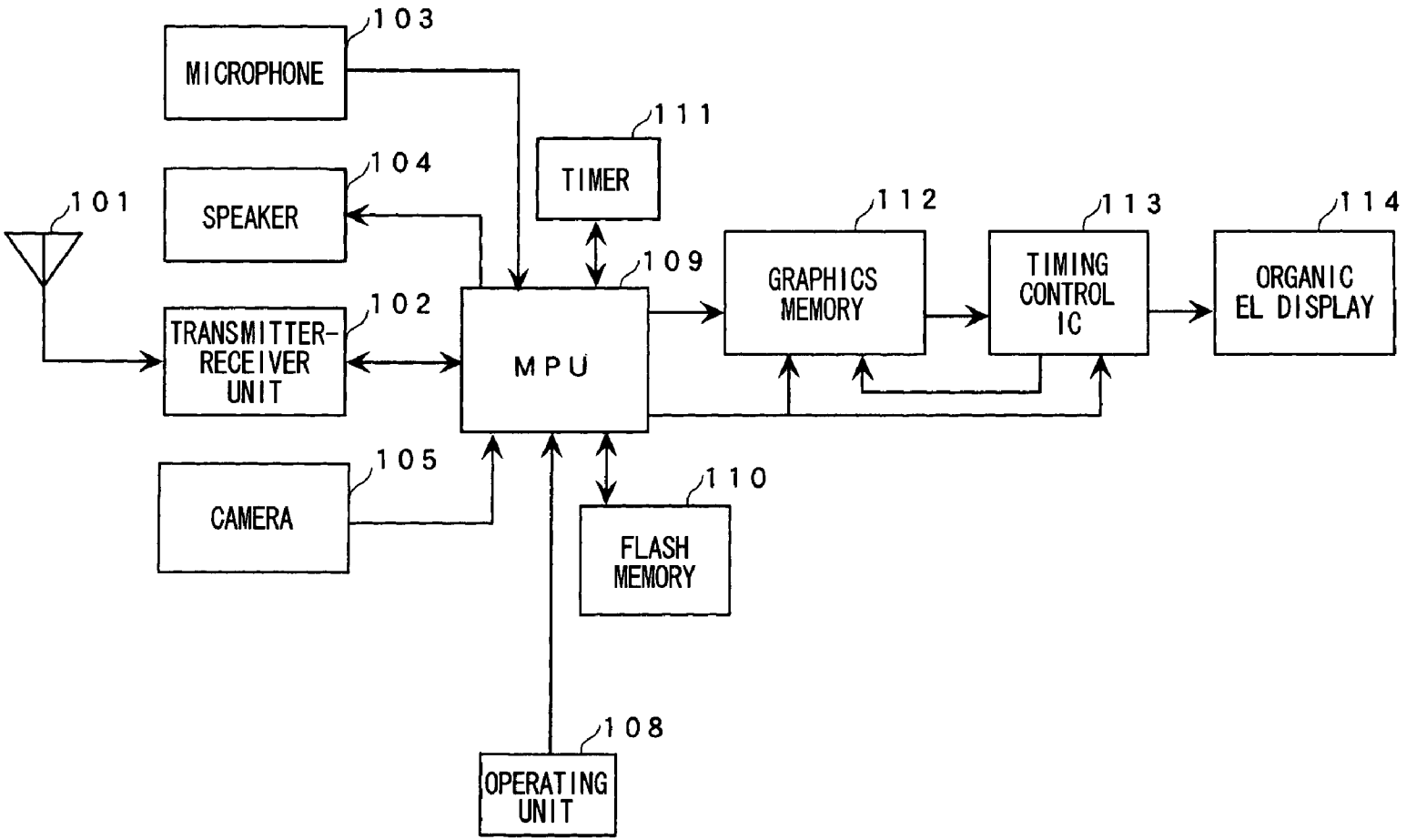
FIG. 11 is a block diagram showing a schematic structure of a cellular phone.

FIG. 11 shows a schematic structure of the cellular phone.

An MPU 109 controls a cellular phone as a whole. An antenna 101 transmits and receives an electric wave. A transmitter-receiver unit 102 receives the electric wave and transmits the received content to the MPU 109. The transmitter-receiver unit 102 transmits a transmission signal outputted from the MPU 109 with the electric wave.

A microphone 103 communicates an audio signal to the MPU 109. A speaker 104 outputs an audio signal outputted from the MPU 109 as a sound. A camera 105 is attached in the front of a main body of the cellular phone in which the organic EL display 114 is formed, and transmits shot image to the MPU 109. At a shooting mode, an image shot by the camera 105 is displayed on the organic EL display 114 instead of a display image at a normal mode.

An operating unit 108 is comprised in the main body of the cellular phone, includes various buttons and various switches. In a flash memory 110, data which should be saved when a power turns off are stored.

In a graphics memory 112, image data to be displayed on the display is stored. Image data is written at the predetermined address in the graphics memory 112 based on the image data and a write control signal outputted from the MPU 109. Pixel data of the pixel corresponding with a display cycle of the organic EL display 114 is outputted from the graphics memory 112 according to a scan timing.

A timing control IC 113 supplies the image data and a driving signal to the organic EL display 114, and displays an image on the organic EL display 114.

In this embodiment, the MPU 109 has a function for controlling a luminance of a whole screen in accordance with a kind of a content displayed on the organic EL display 114.

The kind of the content displayed on the organic EL display 14 may be: (1) an animation (a screen displayed at a camera mode or the like), (2) a mail screen (a screen displayed at a mail mode), (3) a game screen (a screen displayed at a game mode), (4) a calling screen (a screen displayed at a calling mode (during speaking)), (5) an idle screen (a screen displayed at an idle mode).

A gain for controlling the luminance of the whole screen for every kinds of contents is set to the MPU 109 beforehand. The MPU 109 distinguishes the kind of the content displayed on the organic EL display 114 based on the present operating mode, and outputs the gain corresponding thereto to a total luminance control circuit in the timing control IC 113. The total luminance control circuit is described later. The smaller the gain is, the lower the total luminance becomes, as described later.

The relation between the total luminance (Gain) and each content is set as following:

(1) an animation: normal luminance (large gain, gain=1)

(2) a mail screen: The total luminance is lowered because the visibility is maintained even if the luminance is lowered because of high contrast. (middle gain)

(3) a game screen: The total luminance is lowered in the range of maintaining the visibility because a possibility of being continuously displayed over a long time is high, and a possibility of generating the phosphor burn-in phenomenon is high. (middle gain)

(4) a calling screen: The total luminance is lowered because only information which is not much important such as a call time is displayed. (small gain)

(5) an idle screen: The total luminance is lowered because a possibility of being continuously displayed over a long time is high, and a possibility of generating the phosphor burn-in phenomenon is high. (small gain)

[2] Explanation of the Total Luminance Control Circuit in the Timing Control IC 113

Figure 12:
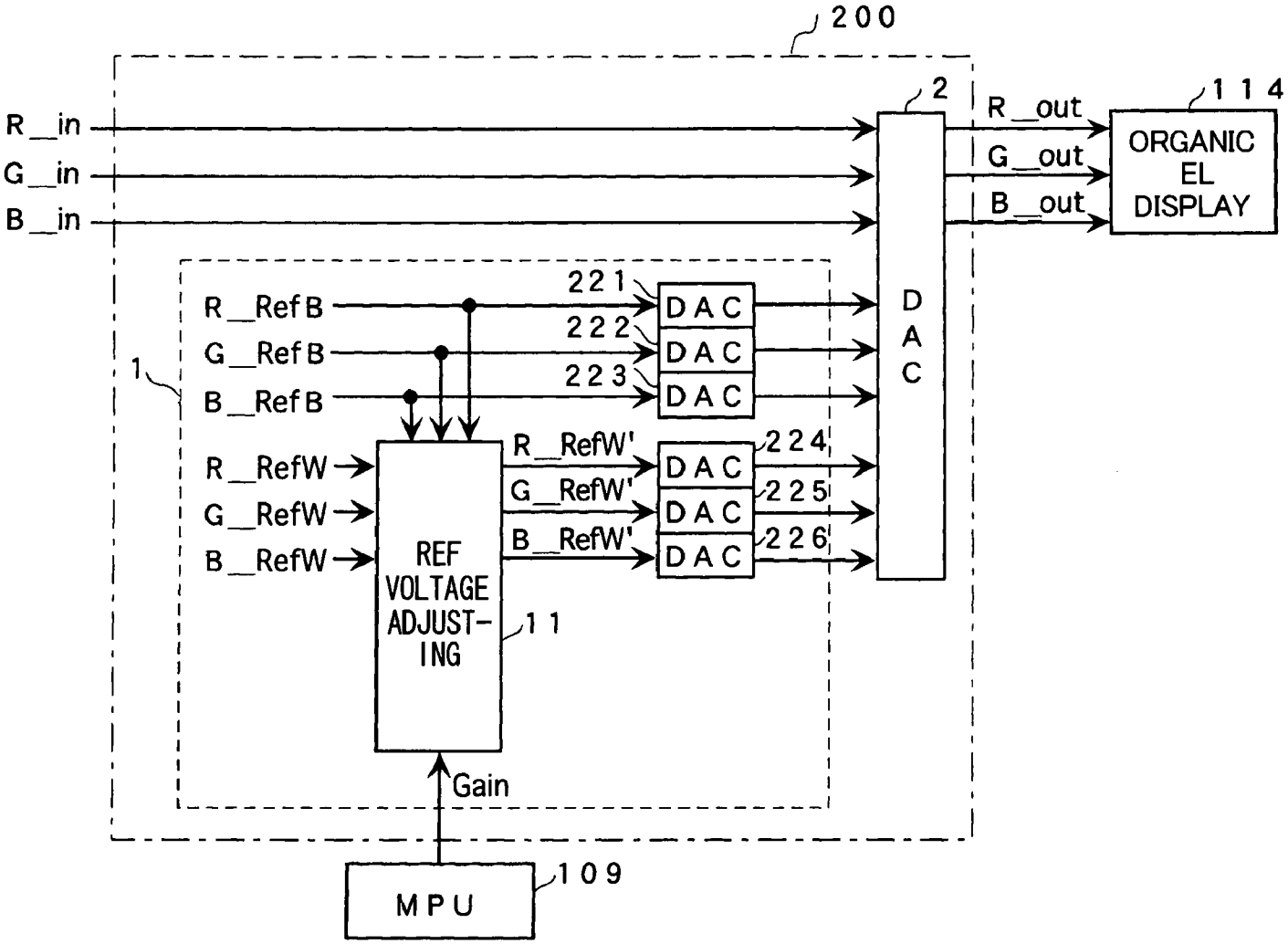
FIG. 12 is a figure showing a structure of a total luminance control circuit comprised in a timing control IC.

FIG. 12 shows a structure of the total luminance control circuit 200 comprised in the timing control IC 113.

The total luminance control circuit 200 comprises a reference voltage control circuit 1 and a DAC 2.

The digital image input signals R_in, G_in, and B_in are transmitted to the DAC 2 and converted to the analog image output signals R_out, G_out, and B_out. Then, the analog image output signals are supplied to the organic EL display 114.

The reference voltage control circuit 1 controls a reference voltage supplied to the DAC 2. There are a black-side reference voltages R_RefB, G_RefB, and B_RefB (these are referred to as the "RefB" as a whole) for each R, G, and B, and a white-side reference voltages R_RefW, G_RefW, and B_RefW (these are referred to as the "RefW" as a whole) for each R, G, and B.

The black-side reference voltage RefB is a basic voltage to define an emitting luminance corresponding to a black level of an input signal. The black-side reference voltage is fixed in this embodiment. The white-side reference voltage RefW is a basic voltage to define an emitting luminance corresponding to a white level of an input signal. The white-side reference voltage is controlled by the reference voltage control circuit 1 in this embodiment.

The DAC 2 converts the digital image input signals R_in, G_in, and B_in to the analog image output signals R_out, G_out, and B_out based on the input/output characteristic defined by the black-side reference voltage RefB and the white-side reference voltage RefW'. The analog image output signals R_out, G_out, and B_out are supplied to the organic EL display 114. These analog image output signals R_out, G_out, and B_out correspond to the display signal Data (Vin) shown in FIG. 9.

The reference voltage control circuit 1 comprises a reference voltage adjusting circuit 11 and a plurality of DACs 221 to 226.

The reference voltage adjusting circuit 11 generates adjusted white-side reference voltages R_RefW', G_RefW', and B_RefW' for each R, G, and B, based on the black-side reference voltages R_RefB, G_RefB, and B_RefB set for each R, G, and B beforehand, and the white-side reference voltages R_RefW, G_RefW, and B_RefW set for each R, G, and B beforehand, and the gain supplied by the MPU 109.

Each basic black-side reference voltage R_RefB, G_RefB, B_RefB and each basic white-side reference voltage R_RefW, G_RefW, B_RefW are supplied as digital signals.

The reference voltage adjusting circuit 11 includes the reference voltage adjusting circuit for each R, G, and B. Here, the reference voltage adjusting circuit for R is explained because structure of reference voltage adjusting circuit for each R, G, and B are the same.

Figure 13:
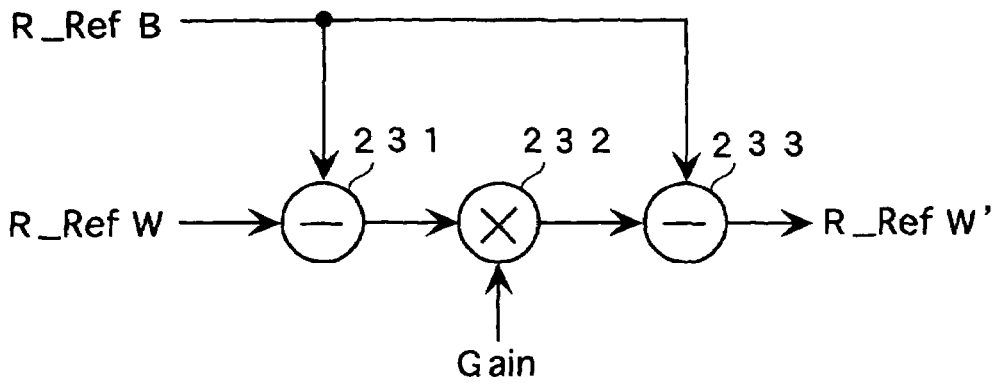
FIG. 13 is a circuit diagram showing a reference voltage adjusting circuit for R.

FIG. 13 shows the reference voltage adjusting circuit for R.

This reference voltage adjusting circuit comprises a subtracter 231, a multiplier 232, and a subtracter 233.

The subtracter 231 calculates a difference between the basic black-side reference voltage R_RefB and the basic white-side reference voltage R_RefW (R_RefB−R_RefW). The multiplier 232 multiplies the output of the subtracter 231 (R_RefB−R_RefW) by the gain. The subtracter 233 calculates the adjusted white-side reference voltage R_RefW' by subtracting the output of the multiplier 232 (gain*(R_RefB−R_RefW)) from the basic black-side reference voltage R_RefB.

If the gain is 1.00, the adjusted white-side reference voltage R_RefW' is equal to the basic white-side reference voltage R_RefW (RefW shown in FIG. 10). The smaller the gain becomes, the larger the adjusted white-side reference voltage R_RefW' becomes, and approaches the basic black-side reference voltage R_RefB (RefB shown in FIG. 10). That is, the smaller the gain becomes, the lower the emitting luminance (driving current) of the organic EL element corresponding to the white level of the input signal becomes.

Each black-side reference voltage R_RefB, G_RefB, B_RefB is converted to the analog signal by the DACs 221, 222, and 223, respectively, and supplied to the DAC 2. Each adjusted white-side reference voltage R_RefW', G_RefW', B_RefW' is converted to the analog signal by the DACs 224, 225, 226, respectively, and supplied to the DAC 2.

Figure 14:
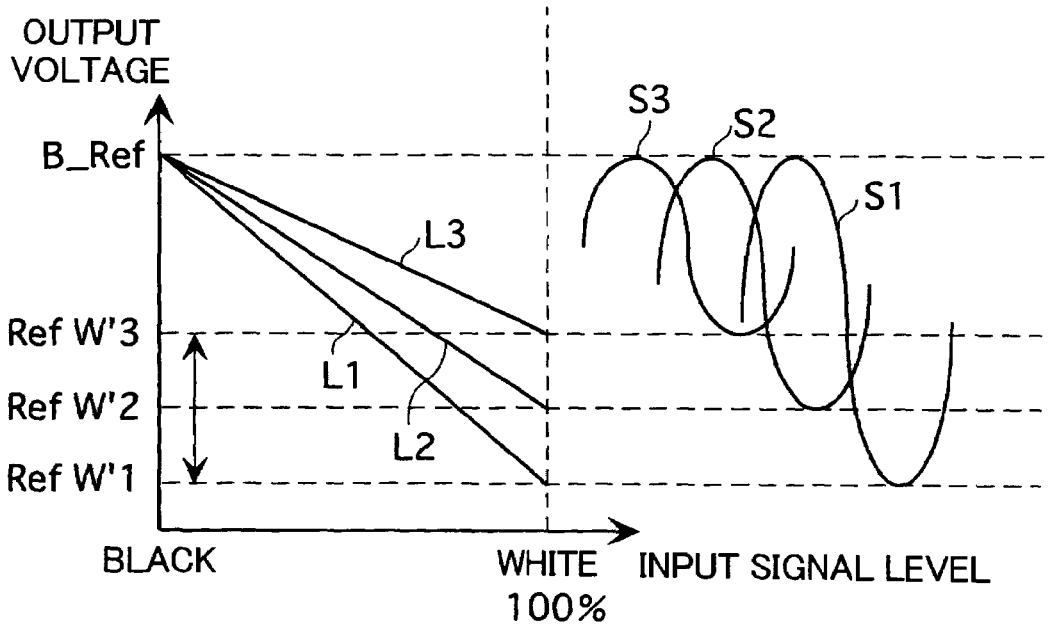
FIG. 14 is a graph showing input/output characteristic of a DAC.

FIG. 14 shows a input/output characteristic of the DAC 2.

In FIG. 14, RefW' 1 shows the white-side reference voltage (=basic white-side reference voltage RefW) supplied to the DAC 2 when the gain is large (gain=1). RefW' 3 shows the white-side reference voltage supplied to the DAC 2 when the gain is small. RefW' 2 shows the white-side reference voltage supplied to the DAC 2 when the gain is middle.

When the white-side reference voltage supplied to the DAC 2 is RefW' 1, the input/output characteristic of the DAC 2 is the characteristic shown by the straight line L1. In this case, if the input signals changing from the black level to the white level are inputted to the DAC 2 periodically, the output wave shown by the curve S1 is obtained. Accordingly, the total luminance becomes high.

When the white-side reference voltage supplied to the DAC 2 is RefW' 3, the input/output characteristic of the DAC 2 is the characteristic shown by the straight line L3. In this case, if the input signals changing from the black level to the white level are inputted to the DAC 2 periodically, the output wave shown by the curve S3 is obtained. Accordingly, the total luminance becomes low.

When the white-side reference voltage supplied to the DAC 2 is RefW' 2, the input/output characteristic of the DAC 2 is the characteristic shown by the straight line L2. In this case, if the input signals changing from the black level to the white level are inputted to the DAC 2 periodically, the output wave shown by the curve S2 is obtained. Accordingly, the total luminance becomes middle of the total luminance in the case where the white-side reference voltage supplied to the DAC 2 is RefW' 1 and the total luminance in the case where the white-side reference voltage is RefW' 3.

That is, the total luminance is controlled by controlling the gain given to the total luminance control circuit 200 according to the kind of the content displayed on the organic EL display 114.

[Effect of the Sixth Embodiment]

According to the sixth embodiment, generation of the phosphor burn-in phenomenon can be prevented in the cellular phone comprising the organic EL display and the degradation of performance of the organic EL element can be reduced.

Although the present invention has been described by way of exemplary embodiments, it should be understood that many changes and substitutions may be made by those skilled in the art without departing from the spirit and the scope of the present invention which is defined only by the appended claims.

What is claimed is:

1. A mobile terminal comprising:

an organic EL display;

a distinction means which distinguishes a type of a content displayed on said organic EL display, the type being one of animation, a mail screen, a game screen a calling screen, and an idle screen;

a control means which controls display luminance of an image to be displayed on said organic EL display in accordance with the type of the content distinguished by said distinction means, wherein the relation between total luminance (Gain) and each content is set such that:

an animation: large gain;

a mail screen: middle gain;

a game screen: middle gain;

a calling screen: small gain; and an idle screen: small gain.

2. The mobile terminal according to claim 1, wherein said control means including:

a DA converter which converts a digital image signal corresponding to the content to be displayed on said organic EL display to an analog image signal, based on an input/output characteristic defined by a given reference voltage, and supplies the analog image signal to said organic EL display; and a reference voltage adjusting circuit which controls the reference voltage to be supplied to said DA converter based on the type of the content distinguished by said distinction means.

3. The mobile terminal according to claim 2, wherein there are a black-side reference voltage for defining an emitting luminance corresponding to a black level of an input signal and a white-side reference voltage for defining an emitting luminance corresponding to a white level of the input signal as reference voltages supplied to said DA converter, and said reference voltage adjusting circuit controls the white-side reference voltage based on the kind of the content distinguished by the distinction means.

4. A luminance control method in a mobile terminal comprising an organic EL display, the method including:

a first step of distinguishing a type of a content to be displayed on the organic EL display, the type being one of animation, a mail screen a game screen, a calling screen, and an idle screen; and a second step of controlling a display luminance of an image to be displayed on the organic EL display in accordance with the type of the content distinguished by the first step, wherein the relation between total luminance (Gain) and each content is set such that:

an animation: large gain;

a mail screen: middle gain;

a game screen: middle gain;

a calling screen: small gain; and an idle screen: small gain.

5. The luminance control method in the mobile terminal according to claim 4, wherein the mobile terminal comprises a DA converter which converts a digital image signal corresponding to the content to be displayed on the organic EL display to an analog image signal, based on an input/output characteristic defined by a given reference voltage, and supplies the analog image signal to the organic EL display; and said second step controls an amplitude of an image input signal by controlling a reference voltage supplied to the DA converter based on the type of the content distinguished by said first step.

6. The luminance control method in the mobile terminal according to claim 5, wherein there are a black-side reference voltage for defining an emitting luminance corresponding to a black level of an input signal and a white-side reference voltage for defining an emitting luminance corresponding to a white level of the input signal as reference voltages supplied to the DA converter, and said second step controls the white-side reference voltage based on the kind of the content distinguished by said first step.

* * * * *